US005482495A

United States Patent [19]

Mayahara et al.

[11] Patent Number: 5,482,495

[45] Date of Patent: Jan. 9, 1996

[54] APPARATUS FOR POLISHING A SPHERICAL SURFACE

[75] Inventors: Kiyoshi Mayahara; Mamoru Inoue, both of Hirakata; Keniti Matumura, Kakogawa, all of Japan

[73] Assignee: Matsushita Electric Industrial Co., Ltd., Osaka, Japan

[21] Appl. No.: 128,088

[22] Filed: Sep. 29, 1993

[51] Int. Cl.[6] ..... B24B 49/00

[52] U.S. Cl. ..... 451/5; 451/8; 451/24; 451/42; 451/292

[58] Field of Search ..... 51/284 R, 123 R, 51/124 R, 124L, 125, 125.5, 126, 129, 131.1, 134, 165.74, 165.71, 165.72; 451/5, 8, 9, 10, 11, 24, 42, 280, 292, 297

[56] References Cited

U.S. PATENT DOCUMENTS

| | | | |
|---|---|---|---|
| 3,769,755 | 11/1973 | Kama et al. | 451/42 |
| 3,857,205 | 12/1974 | Van Hove | 451/42 |
| 4,434,581 | 3/1984 | Spriggs | 451/42 |
| 4,667,445 | 5/1987 | Kimura | 51/131.1 |
| 4,829,716 | 5/1989 | Ueda et al. | 51/124 L |
| 4,885,873 | 12/1989 | Miyazaki | 451/42 |
| 4,907,373 | 3/1990 | Hunter et al. | 51/124 L |
| 4,920,700 | 5/1990 | Murahashi et al. | 51/124 L |
| 5,107,628 | 4/1992 | Kondo et al. | 451/42 |

FOREIGN PATENT DOCUMENTS

| | | |
|---|---|---|
| 61-173852 | 8/1986 | Japan . |
| 3-19740 | 1/1991 | Japan . |

*Primary Examiner*—Maurina T. Rachuba
*Attorney, Agent, or Firm*—Wenderoth, Lind & Ponack

[57] ABSTRACT

An apparatus for polishing spherical surfaces of workpieces includes a polishing device rotating on a shaft thereof while holding a polishing tool at an end of the shaft. A pivoting device pivots the polishing device around a polishing position of the tool. A plurality of workpiece holders each hold a workpiece at an end thereof so that one of the workpieces is opposed to the tool. Workpiece holder-holding devices hold the workpiece holders so as to be rotatably and vertically movably. A workpiece holder-pressing device presses at least one of the workpiece holders held by the workpiece holder-holding device against the tool. A rotary table rotates while holding the workpiece holders and the workpiece holder-holding devices, thus placing at least one of the workpiece holders at a workpiece replacing position when the other of the workpiece holders is placed at the polishing position of the polishing device.

13 Claims, 4 Drawing Sheets

APPARATUS FOR POLISHING A SPHERICAL SURFACE

BACKGROUND OF THE INVENTION

The present invention relates to an apparatus for polishing the spherical surface of an optical lens or the like.

In recent years, optical technique have been utilized more and more in various industrial fields. Consequently, there is a growing demand for optical lenses and, hence, the development of a lens polishing apparatus having high productivity. According to a first conventional method (recess method) for polishing a lens, a plurality of workpieces are adhered to a workpiece holder opposed to one grindstone. According to a second conventional method disclosed in Japanese Laid-Open Patent Publications No. 61-173852 and No. 3-19740, one workpiece is polished by one grindstone.

In the first conventional method, the workpiece is adhered to the workpiece holder. Therefore, it is difficult to operate the apparatus with automation. In the second conventional method, while a polished workpiece is being replaced with an unpolished workpiece, the polishing operation is suspended. Thus, the apparatus has low productivity. In order to polish the lens with high precision, it is necessary to replace the workpiece holder periodically, because the workpiece holder deteriorates in a short period of time. But it takes long for an operator to replace the workpiece holders, because the workpiece holder to be removed from the apparatus is screw-fixed. During the replacing operation, the polishing operation has to be suspended.

SUMMARY OF THE INVENTION

It is an object of the present invention to provide a method and an apparatus capable of performing a polishing operation with high productivity.

In accomplishing these and other objects, according to a first aspect of the present invention, there is provided an apparatus for polishing spherical surfaces of workpieces, comprising: a polishing device rotating on a shaft thereof while holding a polishing tool at an end of the shaft. A pivoting device pivots the polishing device around a polishing position of the tool. A plurality of workpiece holders each held a workpiece at an end thereof, so that one of the workpieces is opposed to the tool. Workpiece holder-holding devices hold the workpiece holders so as to be rotatably and vertically movably. A workpiece holder-pressing device for presses at least one of the workpiece holders held by the workpiece holder-holding device against the tool; and a rotary table for rotate while holding the workpiece holders and the workpiece holder-holding devices, thus placing at least one of the workpiece holders at a workpiece replacing position when the other of the workpiece holders is placed at the polishing position of the polishing device.

According to a second aspect of the present invention, there is provided a method of polishing spherical surfaces of workpieces, comprising the steps of holding the workpiece at an end of each of a plurality of workpiece holders so that one of the workpieces is opposed to a polishing tool, the workpiece holders being held by the workpiece holder-holding devices so as to be rotatably and vertically movable, and polishing the workpiece with the tool while pressing at least one of the workpiece holders held by the workpiece holder-holding device against the tool with a workpiece holder-pressing device. The tool is rotated on a shaft of a polishing device which holds the tool at an end of the shaft, and the device is pivotal around a polishing position of the tool by a pivoting device. After polishing, a rotary table is rotated which holds the workpiece holders and the workpiece holder-holding devices, thus placing one of the workpiece holders which holds the polished workpiece at a workpiece replacing position when the other of the workpiece holders, which holds an unpolished workpiece, is placed at the polishing position of the polishing device.

BRIEF DESCRIPTION OF THE DRAWINGS

These and other objects and features of the present invention will become clear from the following description taken in conjunction with the preferred embodiments thereof and with reference to the accompanying drawings, in which.

DETAILED DESCRIPTION OF THE INVENTION

Figure 1:
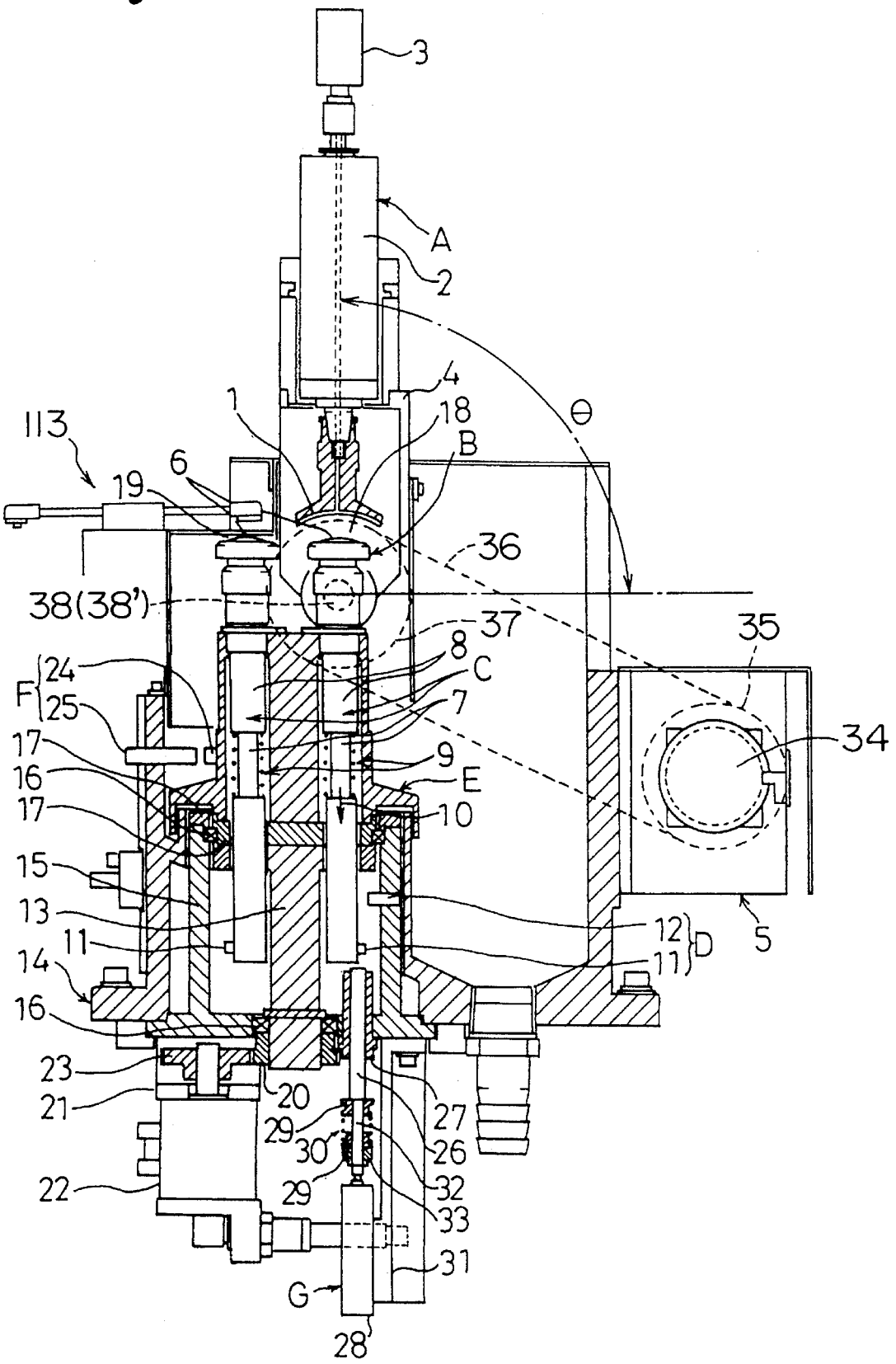
FIG. 1 is a sectional view showing an apparatus for polishing the spherical surface of an optical lens according to an embodiment of the present invention.

Before the description of the present invention proceeds, it is to be noted that like parts are designated by like reference numerals throughout the accompanying drawings.

An apparatus for polishing the spherical surface of an optical mirror, lens or the like is described below with reference to FIGS. 1 through 3.

A polishing device (A) of the apparatus comprises a grindstone 1 for polishing, having a spherical surface at the lower end thereof such as a diamond grinding tool or a grinding polyurethane sheet. A spindle 2 rotates with the grindstone 1 held at an end of the shaft of the spindle. A driving motor 3 is provided for the spindle 2. A pivotal frame 4 holds the spindle 2 and the motor 3, and a driving device 5 can pivot the pivotal frame 4.

A workpiece holder (B) holds a workpiece 6 at the upper end thereof confronting the grindstone 1 and engages the upper end of a shaft 7 of each of workpiece holder-holding devices (C), which will be described later.

Two workpiece holder-holding devices (C) are held on a rotary table (E), which will be described later. The number of the workpiece holder-holding devices (C) is two or more. As described above, the shaft 7 engages the workpiece holder (B) at the upper end thereof and is rotatably and vertically movably held by a sleeve 8 fixed to the rotary table (E).

A pressing spring 9 is disposed around the shaft 7 and between the sleeve 8 and a large-diameter portion of the shaft 7 disposed in the lower portion thereof. There are provided, at a lower portion of the large-diameter portion of the shaft 7, a dog 11 for detecting the upward position of the shaft 7 when the shaft 7 has been moved upward. An upward position detecting device (D) is composed of the dog 11 and a sensor 12, such as a magnetic sensor disposed, on a bearing housing 15, which will be described later.

As described above, the rotary table (E) holds the two workpiece holder-holding devices (C) thereon and rotates on-a rotary shaft 13 thereof, thus positioning one workpiece holder (B) held by one of the workpiece holder-holding devices (C) at a polishing position 18 disposed below the grindstone 1 and another workpiece holder (B) held by the other workpiece holder-holding device (C) at a workpiece replacing position 19. The rotary shaft 13 is rotatably held by a main body frame 14 and the bearing housing 15, fixed to the main body frame 14, via a bearing cap 17 and a bearing 16. A gear 20 is installed on the lower end of the rotary shaft 13 extending below the bearing housing 15 and supported by the bearing housing 15 via the bearing 16. Via a bracket 21, a rotary actuator 22 for rotating the rotary table (E) is mounted on the main body frame 14 at a lower portion thereof below the bearing housing 15. The rotary actuator 22 rotates the rotary shaft 13 via a gear 23 and the gear 20.

The rotary table (E) is provided with a dog 24 for discriminating the workpiece holder-holding devices (C) from each other. The detecting dog 24 and a sensor 25 disposed on the main body frame 14 compose a discriminating device (F) for discriminating the workpiece holder-holding devices (C).

A workpiece holder-pressing device (G) is installed on the main body frame 14 at a portion thereof below the bearing housing 15 via a bracket 31. A pressing cylinder 28 of the workpiece holder-pressing device (G) is installed on the bracket 31. An insertion pin 32 is mounted on the pressing cylinder 28. The upper end of the insertion pin 32 is inserted into a pressing pin 26. Two sliding rings 29 are installed on the insertion pin 32. A pressing spring 30 is interposed between the upper and lower sliding rings 29. A fixing ring 33 regulates the span of each sliding ring 29 and that of the pressing spring 30 so that the pressing force of the pressing spring 30 is applied to the pressing pin 26, namely, to press the pressing pin 26 upward via the sliding rings 29. The upper end of the pressing pin 26 passes through a bush 27 disposed at a lower portion of the bearing housing 15 and is capable of contacting the lower end of the shaft 7 of the workpiece holder-holding device (C) located at the polishing position 18. During a polishing operation, the pressing cylinder 28 is operated, thus pressing the insertion pin 32 upward and as a result, the pressing force of the pressing spring 30 presses the shaft 7 upward via the pressing pin 26 in contact with the lower end of the shaft 7. As a result, the workpiece 6 is pressed against the grindstone 1.

Figure 2:
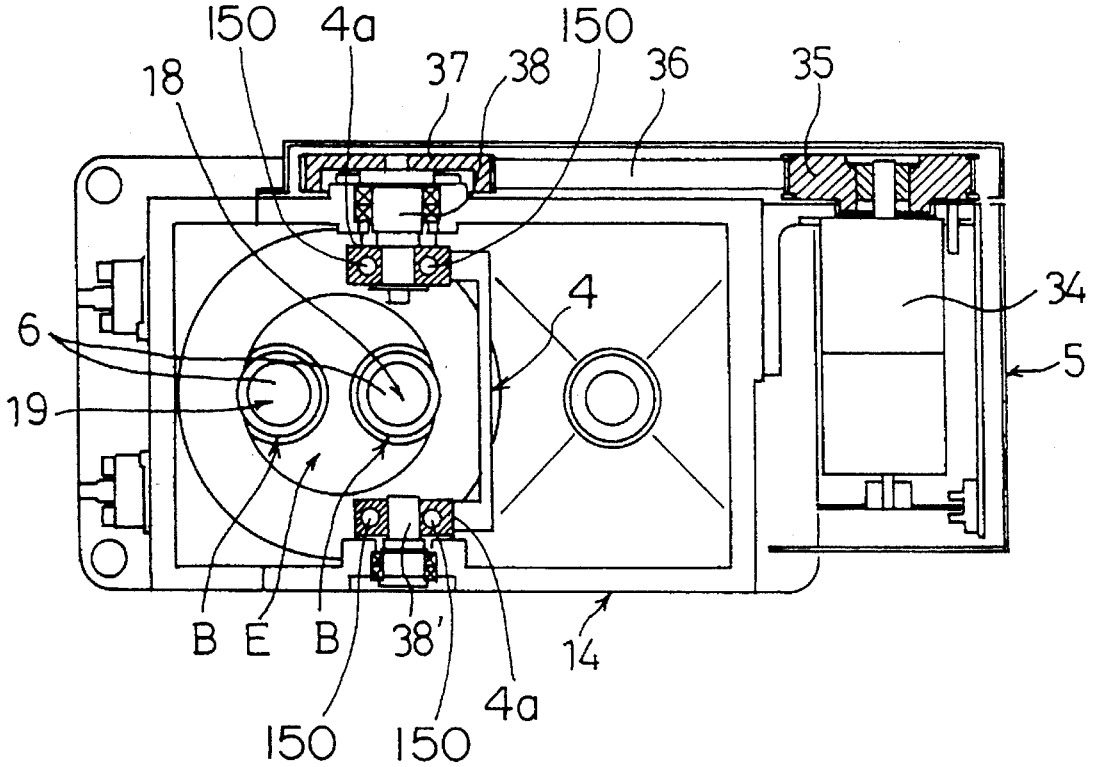
FIG. 2 is a plan view showing the position of a rotary table of FIG. 1.

FIG. 2 is a plan view showing the polishing position 18 of the rotary table (E) and the workpiece replacing position 19 thereof.

Figure 4:
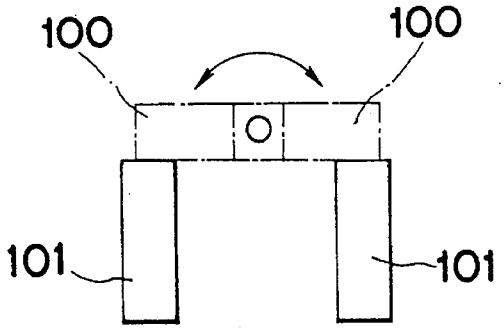
FIG. 4 is a bottom view showing the positional regulation of a rotary table in FIG. 1.
Figure 5:
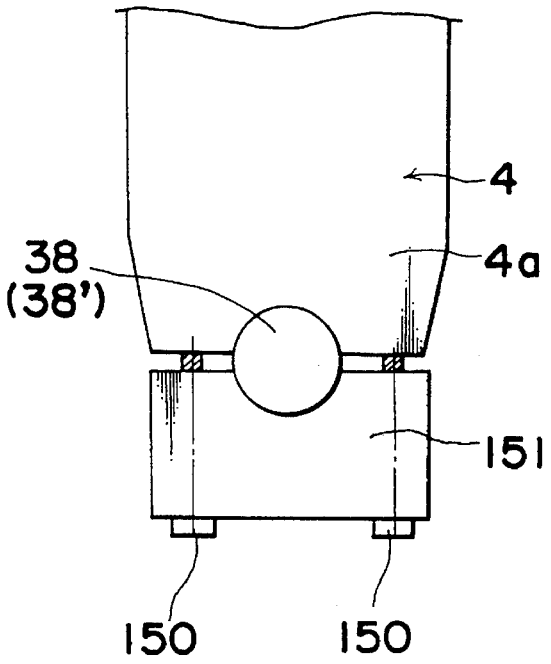
FIG. 5 is a front view of a portion for fixing a pivotal frame to a shaft in FIG. 1.

Referring to FIG. 2, the rotary table (E) rotates, thus positioning one of the workpiece holders (B) at the polishing position 18 and the other workpiece holder (B) at the workpiece replacing position 19 by contacting an arm 100 fixed to the rotary shaft of the rotary actuator 22 with any one of stoppers 101 as shown in FIG. 4. The workpiece 6 placed at the polishing, position 18 is polished and the one placed at the workpiece replacing position 19 is replaced with an unpolished one by an automatic loader 113 that suction a workpiece 6 in supplying the workpiece 6 to the workpiece holder-holding devices (C) or taking it out therefrom. The polishing device (A) is installed on the pivotal frame 4 which pivots on shafts 38' and 38' to ends **4*a* of the pivotal frame 4 are fixed via brackets 151 and bolts 150 to the shafts 38 and 38'. The shaft 38 is driven by the driving device 5 disposed on the main body frame 14. The driving device 5 comprises a motor 34, a pulley 35, a timing belt 36, and a timing pulley 37 and drives the shaft 38 to pivot the pivotal frame 4 within a predetermined angle θ, for example, 90 degree in FIG. 1**.

Figure 3:
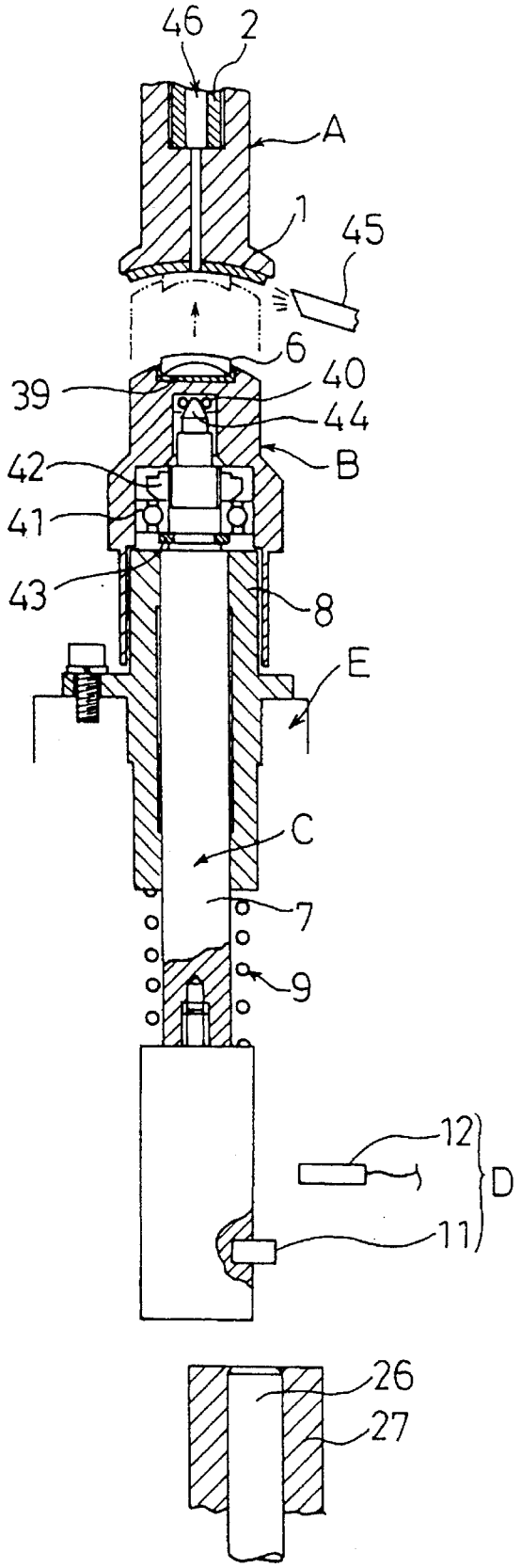
FIG. 3 is a sectional view showing the relationship between a polishing device, a workpiece holder, a workpiece holder-holding device, and a workpiece holder-pressing device in FIG. 1.

FIG. 3 is a sectional view showing the workpiece holder (B) according to this embodiment.

Figure 6:
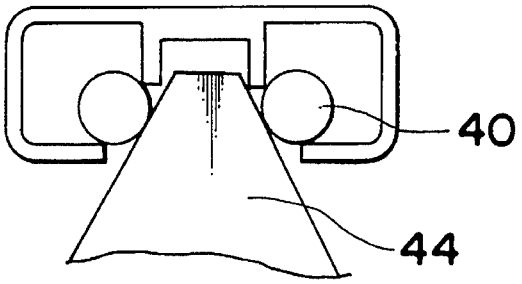
FIG. 6 is a view showing the connection between a workpiece holder and the shaft of a workpiece holder-holding device via a bearing.

Referring to FIG. 3, the workpiece holder (B) holds the workpiece 6 at the upper end thereof opposed to the grindstone 1 via an elastic member 39. In a gap between the workpiece holder (B) and the shaft 7 engagedly inserted into the workpiece holder (B), as shown in FIG. 6, a pivot 44 disposed at the upper end of the shaft 7 is in contact with a tapered portion of a bearing 40 installed on the workpiece holder (B). An intermediate portion of the workpiece holder (B) is in contact with a bearing 41 fixed to the shaft 7 at the vicinity of the upper end thereof by means of a nut 42 and a bearing stopper 43. More specifically, in the gap between the workpiece holder (B) and the shaft 7 of the workpiece holder-holding device (C), there are formed tapered ring-shaped portions in which the workpiece holder (B) and the workpiece holder-holding device (C) contact each other via a bearing fixed to either the workpiece holder (B) or the workpiece holder-holding device (C). At least one tapered ring-shaped portion has a tapered surface such that the diameter thereof is gradually increased as the workpiece holder-holding device (C) is engagedly inserted into the workpiece holder (B), as shown in FIG. 6. In this manner, the workpiece holder-holding device (C) can be quickly engaged with the workpiece holder (B) or quickly disengaged there from other. The workpiece holder (B) is rotatable because the workpiece holder (B) and the shaft 7 of the workpiece holder-holding device (C) contact each other via the bearing 40. During a polishing operation, since the grindstone 1 rotates and pivots, the relative position between the rotary shaft of the grindstone 1 and that of the workpiece 6 or the workpiece holder (B) always changes. Consequently, the rotational direction of the portion pressing the workpiece 6 always changes. Thus, the workpiece holder (B) rotates with the number of rotations thereof always changing. Accordingly, the workpiece 6 is polished by the grindstone 1, with sliding contact occurring therebetween. Reference numeral 45 denotes a pipe for supplying polishing liquid during the polishing operation to the workpiece 6 and the grindstone 1.

When the polishing operation terminates, the supply of polishing liquid from the pipe 45 is stopped. As a result, the pressing cylinder 28 moves downward and the pressing pin 26 moves away from the lower end of the shaft 7 of the workpiece holder-holding device (C). When pressurized air 46 supplied from the polishing device (A) is fed between the grindstone 1 and the workpiece 6, the workpiece 6 moves away from the grindstone 1 and the shaft 7 is moved downward by the operation of the pressing spring 9 and the workpiece holder (B) moves downward.

With the downward movement of the workpiece holder (B), the rotary table (E) rotates, thus exchanging the positions of the two workpiece holder-holding devices (C) with each other.

The operation of the apparatus according to this embodiment is described below.

In this embodiment, the rotary table (E) rotates while holding the two workpiece holders (B) and the two workpiece holder-holding devices (C). When one of the workpiece holders (B) is placed at the polishing position 18 of the polishing device (A), the other workpiece holder (B) is placed on the workpiece replacing position 19. Therefore, while the workpiece 6 held by one of the workpiece holders (B) placed at the polishing position 18 is being polished, the polished workpiece 6 held by the other workpiece holder (B) placed at the workpiece replacing position 19 can be replaced with an unpolished workpiece 6. Accordingly, as soon as the polishing operation of the workpiece 6 is completed, the workpiece holder-holding device (C) is moved downward to move the workpiece 6 held by the workpiece holder (B) away from the grindstone 1. Then, the rotary table (E) is rotated to place the workpiece holder (B) holding the polished workpiece 6 at the workpiece replacing position 19 and place the workpiece holder (B) holding the unpolished workpiece 6 at the polishing position 18. In this manner, the polishing operation and the workpiece replacing operation can be started immediately.

In this embodiment, the polishing device (A) is disposed at an upper portion of the apparatus. The rotary table (E) is disposed below the polishing device (A). The workpiece holder-pressing device (G) disposed below the rotary table (E) and the polishing position 18 presses the workpiece holder (B), held by the workpiece holder-holding device (C) placed at the polishing position 18 by the rotation of the rotary table (E), against the grindstones. Then, the grindstone 1 can be pressed by the workpiece holder (B) of the workpiece holder-holding device (C) placed at the polishing position 18. Therefore, the apparatus has a simple construction and can be manufactured at a low cost.

The discriminating device (F) discriminates which of the workpiece holder-holding device (C) has been placed at the polishing position 18. Since the properties of the workpiece holder-holding devices (C) are different from each other, it is necessary to operate each workpiece holder-holding device (C) under individual polishing conditions such as the period of polishing time, the number of pivotal motions of the polishing device (A), the position of the polishing device (A) with respect to the workpiece 1, and the amplitude of the polishing device (A). Based on the discrimination made by the discriminating device (F), the workpiece 6 can be polished under the conditions suitable for each workpiece holder-holding device (C).

Further, the upward position detecting device (D) is provided to detect the upward position of the workpiece holder (B) and that of the workpiece holder-holding device (C) placed at the polishing position 18. Accordingly, it can be detected whether or not the workpiece holder (B) holds the workpiece 6, normally, depending on the detected position. If the upward position detecting device (D) has detected an abnormal condition, the polishing operation is suspended to correct the abnormality.

In the gap between the workpiece holder (B) and the workpiece holder-holding device (C), there are formed tapered ring-shaped portions in which the workpiece holder (B) and the workpiece holder-holding device (C) contact each other via the bearing 40 fixed to either the workpiece holder (B) or the workpiece holder-holding device (C). The diameter of at least one tapered ring-shaped portion is gradually increased in the direction in which the workpiece holder-holding device (C) is engagedly inserted into the workpiece holder (B). In this manner, the workpiece holder-holding device (C) can be quickly engaged by the workpiece holder (B) or quickly disengaged from each other. Therefore, this construction allows an operator to perform workpiece holder-replacing operation required periodically in a shorter period of time, thus improving the productivity.

Various modifications of the above-described embodiment can be made. For example, the rotary table can be freely designed and the driving device can be freely selected. A pulse motor can be used instead of the rotary actuator so long as one of the workpiece holders (B) can be placed at the polishing position 18 and the other workpiece holder (B) can be placed at the workpiece replacing position 19.

Further, the workpiece holder-pressing device (G) can be freely designed, so long as the workpiece holder-pressing device (G) is capable of pressing the workpiece holder (B) placed at the polishing position 18 against the polishing device (A).

The driving device 5 for driving the pivotal frame 4 can also be freely designed in conformity to the construction of the apparatus. For example, a link mechanism can be adopted instead of the belt 36.

It is possible to modify the construction and design of the dog 11 and the sensor 12 of the upward position detecting device (D) and those of the dog 24 and the sensor 25 of the discriminating device (F) in conformity to the construction of the apparatus.

It is possible to manually rotate the rotary table (E) without the rotary actuator 22.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An apparatus, comprising:

a polishing device comprising a rotatable shaft and a polishing tool on an end of said rotatable shaft;

a pivoting means for pivoting said polishing device around a polishing position of said polishing tool when a polishing operation is performed;

a plurality of workpiece holders, each of said workpiece holders having a workpiece holding end;

a plurality of workpiece holder holding means for holding respective ones of said workpiece holders so as to be rotatable and vertically movable;

a workpiece holder pressing means for pressing at least one of said workpiece holders held by said plurality of workpiece holder holding means toward said polishing tool; and a rotary means for rotating said workpiece holder holding means and said workpiece holders between a workpiece replacing position and said polishing position of said polishing tool;

wherein each of said workpiece holders and the respective said workpiece holder holding means have a gap therebetween;

wherein an annular tapered portion is formed on one of said workpiece holder and the respective said workpiece holder holding means at said gap contacting the other of said workpiece holder and the respective said workpiece holder holding means through a bearing fixed to one of said workpiece holder and the respective said workpiece holder holding means; and wherein said annular tapered portion tapers upwardly.

2. The apparatus of claim 1, wherein said rotary means comprises a rotary table holding said plurality of workpiece holder holding means, and wherein said workpiece holder pressing means is located below said rotary table for pressing one of said workpiece holders held by one of said plurality of workpiece holder holding means toward said polishing tool when located at said polishing position by rotation of said rotary table and for separating from said plurality of workpiece holder holding means.

3. The apparatus of claim 2, and further comprising means for rotating said rotary table.

4. The apparatus of claim 1, and further comprising a means for sensing which of said plurality of workpiece holder holding means is located at said polishing position.

5. The apparatus of claim 1, and further comprising a means for detecting at least one of an upper position of said plurality of workpiece holders and an upper position of said plurality of workpiece holder holding means at said polishing position.

6. A method of polishing spherical surfaces of workpieces, comprising the steps of:

holding a workpiece at an end of each of a plurality of workpiece holders so that one of the workpieces is located opposite to a polishing tool in a polishing position, the workpiece holders being held by workpiece holder holding devices such that the workpiece holders are movable both rotatably and vertically, and the polishing tool being held by a shaft of a polishing device at an end thereof;

polishing the workpiece with the polishing tool while pressing the workpiece holder holding the workpiece, the workpiece holder being held by a respective workpiece holder holding device, against the polishing tool with a workpiece holder pressing device, rotating the shaft of the polishing device holding the polishing tool and pivoting the polishing device around the polishing position with a pivoting device; and after said step of polishing, rotating a rotary table holding the workpiece holder holding devices and the workpiece holders such that the workpiece holder holding the workpiece that has been polished is moved to a workpiece replacing position while another of the workpiece holders, holding an unpolished workpiece, is moved to the polishing position;

wherein the workpiece holders are rotatably mounted on the workpiece holder holding devices, and wherein said step of polishing comprises rotating the workpiece being polished and the workpiece holder holding the workpiece being polished with the polishing tool by the rotation of the shaft holding the polishing tool.

7. An apparatus, comprising:

a polishing device comprising a rotatably driven shaft having a polishing tool held at an end thereof such that said polishing tool is located at a polishing position, said polishing device being pivotable about an axis such that said polishing tool is movable around said polishing position;

a pivoting device connected with said polishing device for pivoting said polishing device about said axis;

a rotary table located adjacent to said polishing position and adjacent to a workpiece replacing position;

a plurality of workpiece holder holding devices each having an axis and each mounted in said rotary table so as to be movable along said axis relative to said rotary table;

a plurality of workpiece holders rotatably mounted on respective said workpiece holder holding devices; and a workpiece holder pressing device for pressing a workpiece holder at said polishing position toward said polishing tool;

wherein said rotary table can rotate said plurality of workpiece holder holding devices having said workpiece holders thereon between said polishing position and said workpiece replacing position; and wherein each of said workpiece holder holding devices is received in a respective one of said plurality of workpiece holders with at least one bearing therebetween.

8. The apparatus of claim 7, wherein each of said workpiece holder holding devices has a tapered upper end engaging said bearing in an interior space of the respective said workpiece holder.

9. The apparatus of claim 7, wherein said workpiece holder holding devices are biased toward a position in which the respective said workpiece holder is located away from said polishing position, and said workpiece holder pressing device comprises a pressing pin located below said rotary table and said polishing position and a pressing cylinder for moving said pressing pin into engagement with one of said workpiece holder holding devices when the one of said workpiece holder holding devices is located below said polishing position for moving the one of said workpiece holder holding devices toward said polishing position.

10. The apparatus of claim 9, and further comprising a sensor for sensing when said workpiece holder holding device is at an upper position.

11. The apparatus of claim 7, wherein said rotary table has openings therein through which respective ones of said plurality of workpiece holder holding devices extend, and wherein said rotary table is rotatably mounted relative to a frame.

12. The apparatus of claim 11, and further comprising a sensor on said frame for sensing the rotational position of said rotary table.

13. The apparatus of claim 11, wherein said rotary table has a motor connected therewith for rotating said rotary table relative to said frame and to move said workpiece holder holding devices between said polishing position and said workpiece replacing position.

* * * * *